US009809788B2

(12) United States Patent
Pan et al.

(10) Patent No.: US 9,809,788 B2
(45) Date of Patent: Nov. 7, 2017

(54) BAR SOAP COMPOSITION AND METHOD OF MANUFACTURE

(71) Applicant: Colgate-Palmolive Company, New York, NY (US)

(72) Inventors: Long Pan, Cherry Hill, NJ (US); Diana Scala, Hillsborough, NJ (US); Donghui Wu, Bridgewater, NJ (US); Jairaj Mattai, Piscataway, NJ (US); Christine Boyke, Somerset, NJ (US); Minli Shi, Highland Park, NJ (US); Diane Curley, Milltown, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/649,832

(22) PCT Filed: Dec. 7, 2012

(86) PCT No.: PCT/US2012/068396
§ 371 (c)(1),
(2) Date: Jun. 4, 2015

(87) PCT Pub. No.: WO2014/088587
PCT Pub. Date: Jun. 12, 2014

(65) Prior Publication Data
US 2015/0322388 A1 Nov. 12, 2015

(51) Int. Cl.
*C11D 9/26* (2006.01)
*C11D 13/18* (2006.01)
*C11D 17/00* (2006.01)
*C11D 10/04* (2006.01)

(52) U.S. Cl.
CPC ..... *C11D 9/26* (2013.01); *C11D 10/045* (2013.01); *C11D 13/18* (2013.01); *C11D 17/006* (2013.01); *C11D 17/0017* (2013.01)

(58) Field of Classification Search
CPC ..... C11D 9/26; C11D 13/18; C11D 17/00
See application file for complete search history.

(56) References Cited

U.S. PATENT DOCUMENTS

| | | | | |
|---|---|---|---|---|
| 3,829,563 | A * | 8/1974 | Barry | A61K 8/062 424/70.21 |
| 4,011,170 | A | 3/1977 | Pickin et al. | |
| 4,749,501 | A | 6/1988 | Nakagawa et al. | |
| 5,139,781 | A | 8/1992 | Birtwistle et al. | |
| 5,753,245 | A * | 5/1998 | Fowler | A61Q 5/02 424/401 |
| 5,900,394 | A * | 5/1999 | Goel | A61K 8/062 510/141 |
| 6,149,926 | A * | 11/2000 | Venkitaraman | A61K 8/0208 424/401 |
| 6,255,264 | B1 | 7/2001 | Fleurot et al. | |
| 6,488,780 | B2 | 12/2002 | Cauwet-Martin | |
| 7,045,491 | B2 | 5/2006 | Hourigan | |
| 7,994,110 | B2 | 8/2011 | Wenk et al. | |
| 8,729,137 | B2 | 5/2014 | Misner et al. | |
| 2004/0120917 | A1* | 6/2004 | Perrier | A61K 8/4953 424/70.14 |
| 2004/0175403 | A1 | 9/2004 | Lukenbach et al. | |
| 2004/0198620 | A1 | 10/2004 | Johansson et al. | |
| 2005/0261159 | A1 | 11/2005 | Parris et al. | |
| 2011/0171331 | A1 | 7/2011 | Myers | |
| 2015/0322388 | A1* | 11/2015 | Pan | C11D 10/045 510/152 |

FOREIGN PATENT DOCUMENTS

| | | | | |
|---|---|---|---|---|
| CN | 101554357 | A | 10/2009 | |
| CN | 102260608 | A | 11/2011 | |
| EP | 2041064 | B1 | 10/2012 | |
| GB | 1168577 | | 10/1969 | |
| GB | 1168577 | A * | 10/1969 | C11D 9/10 |
| JP | H03-279319 | | 12/1991 | |
| RU | 2251405 | C2 | 5/2005 | |
| WO | WO 94/01085 | | 1/1994 | |
| WO | WO9526710 | | 10/1995 | |
| WO | WO 97/45525 | | 12/1997 | |
| WO | WO 99/11748 | | 3/1999 | |
| WO | WO 99/24546 | | 5/1999 | |
| WO | WO 00/36075 | | 6/2000 | |
| WO | WO 01/72262 | C2 | 10/2001 | |
| WO | WO 03/057793 | | 7/2003 | |
| WO | WO 2005/044212 | | 5/2005 | |
| WO | WO 2005/058271 | | 6/2005 | |
| WO | WO 2006/124224 | | 11/2006 | |
| WO | WO 2010/079054 | | 7/2010 | |
| WO | WO2011/026039 | | 3/2011 | |

OTHER PUBLICATIONS

Elwell et al., 2003, "Effect of homogenization and surfactant type on the exchange of oil between emulsion droplets," Food Hydrocolloids 18(3):413-418.

International Search Report and Written Opinion in International Application No. PCT/US2012/068396, dated Aug. 30, 2013.

O'Lenick, Jr., 1999, "Ch. 9: Specialty Silicone Conditioning Agents," Conditioning Agents for Hair and Skin, Schueller et al., eds., pp. 201-221.

Weiss et al., 1997, "Influence of molecular structure of hydrocarbon emulsion droplets on their solubilization in nonionic surfactant micelles," Colloids and Surfaces A: Physicochemical and Engineering Aspects 121(1):53-60.

* cited by examiner

*Primary Examiner* — Nicole M Buie-Hatcher
*Assistant Examiner* — M. Reza Asdjodi

(57) ABSTRACT

A soap bar composition comprising solid soap and an oil-in-water emulsion, wherein the emulsion comprises one or more surfactants and wherein the emulsion is dispersed within the solid soap.

18 Claims, No Drawings

BAR SOAP COMPOSITION AND METHOD OF MANUFACTURE

BACKGROUND OF THE INVENTION

Soap bars generally contain solid soap together with other components depending on the properties desired in the soap bar. Typically, the solid soap component is a salt of a long chain fatty acid which has both hydrophilic and hydrophobic properties. Thus, cleansing of skin or clothing is made possible by the soap, which disperses hydrophobic grease or oil into polar water during washing.

Incorporation of other components into soap bars such as water, emollient oils or other functional components is often desirable for achieving higher levels of moisturization or to make cleansing conditions less harsh. For example, it is known to incorporate a water-in-oil emulsion into bar soaps together with an emollient and a surfactant. However, incorporation of water or other components tends to be at the expense of the structural integrity of the soap bar or to be detrimental to the cleansing properties thereof. Higher loading of water into bar soap can cause structural problems such as cracking of the bar over time.

There is therefore a need in the art for improved soap bar compositions.

BRIEF SUMMARY OF THE INVENTION

The invention aims at least partially to meet these needs in the art.

In a first aspect, the present invention provides a soap bar composition comprising solid soap and an oil-in-water emulsion, wherein the emulsion comprises one or more surfactants and wherein the emulsion is dispersed within the solid soap.

It has been found that, by using an oil-in-water emulsion in combination with one or more surfactants, additional water may be incorporated into the soap bar composition without adversely affecting the structural integrity of the soap bar. Some conventional soap bars which encounter cracking problems with higher levels of water or humectants whereas the soap bars of the present invention are able to accommodate more water. This allows the soap bars to be manufactured at a lower cost. By incorporation of additional water and optionally further ingredients such as humectants or emollients, soap bars according to the invention leave the skin feeling softer and less dry than conventional soap bars. Soap bars according to the invention also provide improved lathering. Although a higher loading of water is possible according to the invention, this is found not to impact negatively on slough formation which arises when the surface of the bar hydrates. It is also found not to impact negatively on use up resulting from the mechanical action of physical abrasion on the surface to be cleansed.

In a further aspect, the present invention provides a method of manufacturing a soap bar, comprising:

preparing an oil-in-water emulsion comprising at least one surfactant;

mixing the emulsion with soap to form a soap mixture; and forming the mixture into one or more bars.

The present invention further provides a soap bar composition obtainable by this method.

The present invention further provides use of the soap bar composition according to the invention as a personal care product.

DETAILED DESCRIPTION OF THE INVENTION

The following description of the preferred embodiment(s) is merely exemplary in nature and is in no way intended to limit the invention, its application, or uses The soap bar of the invention comprises solid soap and an oil-in-water emulsion. The emulsion comprises one or more surfactants and is dispersed within the solid soap. Typically, the emulsion contains water in an amount that is at least 5% by weight of the soap bar composition, optionally in an amount of 5 to 35, 5 to 15, 9 to 15, or 9.4 to 15%. In other embodiments, total water in the soap bar composition is 20 to 35% by weight of the soap bar composition. Introduction of the water into the composition is facilitated by the oil-in-water emulsion, which significantly improves water incorporation into soap chips to maintain moisture. The emulsion is also able to build rich lather coupled with solid soap suitable for skin care. Use of a higher loading of water into bar soap offers lower production costs as well.

Typically, the emulsion is present in the composition in an amount of at least 5% by weight of the composition. Preferably, the composition comprises the emulsion in an amount in the range 5 to 10%, preferably 5 to 15%, more preferably around 10% by weight of the composition.

The amount of water present in the emulsion is typically in the range greater than 50% to 98% by weight of the emulsion, preferably in an amount in the range 80 to 98% or 90 to 98% by weight of the emulsion, more preferably around 95% by weight of the emulsion.

In certain embodiments, the oil of the oil-in-water emulsion is present in the emulsion in an amount in the range 1% to 3% by weight of the emulsion, preferably 1% to 2% by weight of the emulsion, more preferably about 1.5% by weight of the emulsion. When loaded with hydrophobic ingredients, the total oil phase can increase up to an amount that is less than 50% by weight of the emulsion, optionally up to 40% by weight.

Typically, the one or more surfactants are present in a total amount in the range 1% to 6% by weight of the emulsion, preferably in the range 3% to 5% by weight of the emulsion, or preferably 3% to 4% by weight of the emulsion, such as around 3.5% by weight of the emulsion.

In certain embodiments, the surfactant has an HLB less than 13, optionally, less than 10. In other embodiments, the HLB of the surfactant is 4 to less than 10, optionally about 5. In one arrangement, the oil in the oil-in-water emulsion is a polypropylene glycol stearyl ether such as PPG-15 stearyl ether. Other oils which may be used in the oil-in-water emulsion are described below.

In one arrangement, the surfactant is selected from steareth-2, steareth-20 and mixtures thereof. Other suitable surfactants are described below.

The solid soap may comprise a salt of lauric acid and/or a salt of tallow. In one arrangement, the soap is a mixture of the two salts. The salt of lauric acid may be present in an amount of about 5% by weight of the soap. The salt of tallow may be present in an amount of about 95% by weight of the soap.

The composition may further comprise at least one further functional ingredient which may be incorporated into the oil-in-water emulsion. The functional ingredient is a hydrophobic ingredient. Examples of hydrophobic ingredients include, but are not limited to hydrophobic antimicrobial agents, such as trichlorocarbanilide (TCC) or triclosan, fragrance, such as D-limonene or ethyl buyrate, or oils. The oil in water emulsion will allow for greater delivery of the hydrophobic ingredient.

A method of manufacturing a soap bar according to the invention comprises:

preparing an oil-in water emulsion comprising at least one surfactant;

mixing the emulsion with soap to form a soap mixture; and forming the mixture into one or more bars. Typically, the soap mixture is extruded before being formed into the one or more bars.

The preparation of the oil-in-water emulsion may comprise the steps of preparing an aqueous phase;

preparing an oil phase;

mixing the aqueous phase and the oil phase; and homogenising the mixture to form an emulsion; wherein the aqueous phase and/or the oil phase comprises one or more surfactants.

Typically, the amounts and identities of the components used in the method are described in further detail above.

The aqueous phase and the oil phase may be homogenised at a homogenisation temperature of at least 40° C., optionally at least 50° C. Advantageously, the step of mixing the aqueous phase and the oil phase is carried out at a mixing temperature of at least 40, optionally at least 50° C. Further advantageously, the step of preparing the aqueous phase and/or the step of preparing an oil phase may be carried out at a preparation temperature of at least 40, optionally at least 50° C. In some arrangements the homogenisation, mixing and/or preparation temperature may be at least 60° C. or at least 70° C. Operating the method at temperatures of 50° C. or higher facilitates formation of the emulsion.

Following homogenisation, the method may further comprise the step of cooling the emulsion to room temperature, which is typically 25° C. or lower, such as 23° C. or lower, 22° C. or lower, 21° C. or lower or 20° C. or lower, before the step of mixing the emulsion with soap. The soap for mixing may be supplied in the form of soap chips or any other conventional form.

To increase the stability of the soap bars, water insoluble binders can be selected. One type of water insoluble binder is wax. When formulated with water insoluble binders, the cleansing bar is resistant to wet environments.

Examples of waxes are hydrogenated soybean oil, ceresine, ozokerite, carnauba, bees wax, candelilla, and microcrystalline wax. In one embodiment, the hydrogenated oil is hydrogenated soybean oil. Also described herein are hydrogenated oils, petroleum waxes, paraffin, castor wax, polymethylene wax and polyethylene wax. In one embodiment, the hydrogenated soybean oil is almost, but not fully hydrogenated. The amount of hydrogenation is measured by the iodine value. The iodine value can be measured by ASTM D5554-95 (2006). In one embodiment, the iodine value of the hydrogenated soybean oil used herein is greater than 0 to 20. In one embodiment, the iodine value is 1 to 5. In another embodiment, the soybean oil is fully hydrogenated with an iodine value of 0. In another embodiment, the iodine value is up to 20. In one embodiment, the amount of hydrogenated soybean oil is 4 to 5 weight %.

The soap bars may include fatty material. Fatty material refers to a fatty acid/alcohol with a $C_8$-$C_{22}$ unbranched aliphatic tail (chain), which is either saturated or unsaturated. The hydrophobic property of the fatty material is used to improve dispersibility.

Types of fatty material include, but are not limited to, oils, fatty acids in acid form, and fatty alcohols. Examples of fatty material include, but are not limited to, palm kernel oil, stearyl alcohol, and behenyl alcohol. The amount of fatty material can be any desired amount. Generally, the amount is less than 8 weight % to minimize the effect of reducing lather. In certain embodiments, the amount of fatty material is 0.01 to 8 weight %. While residual fatty acids can be present in soap bars, the amount of fatty acid herein is an amount that provides structure to form a soap bar.

In certain embodiments, the binder comprises the hydrogenated soybean oil, in particular the 1-5 iodine value hydrogenated soybean oil, and the fatty material comprises palm kernel oil. This combination will make the soap bar more plastic to reduce or eliminate cracking and to reduce the slough from the bar.

Soap refers to the salts of fatty acids that are typically used to make soap bars. Soap bars can also include synthetic surfactants to make combars (mixture of soap and synthetic surfactant). Soap can be a blend of 65-95 weight % $C_{16}$-$C_{18}$ and 5-35 weight % $C_{12}$-$C_{14}$ fatty acids based on the total weight of the soap. In one embodiment, the blend is 80/20, in another the blend is 95/5. As used throughout, a reference to 80/20 soap refers to this blend. The $C_{16}$-$C_{18}$ can be obtained from tallow, and the $C_{12}$-$C_{14}$ can be obtained from lauric, palm kernel, or coconut oils. A typical 80/20 neat soap contains 68.8 weight % sodium soap, 30 weight % water, 0.5 weight % glycerin, 0.5 weight % sodium chloride, and 0.2 weight % sodium hydroxide. In certain embodiments, the soap bar is all fatty acid soap. In other embodiments, the soap bar is a combar. In certain embodiments, the combar is at least 50%, at least 60%, at least 70%, at least 80% by weight of fatty acid soap.

The soap chips useful herein for the purpose of this invention also include but are not limited to the well known alkali metal salts of aliphatic (alkanoic or alkenoic) acids having about as 8 to 22 carbon atoms alkyl, preferably 10 to 20 carbon atoms alkyl chain. These may be described as alkali metal carboxylates of acrylic hydrocarbons having about 12 to about 22 carbon atoms. Any other surfactant can also be present in the soap chip such as those mentioned in U.S. Pat. No. 5,139,781 at column 5, line 35 to column 11, line 46. In certain embodiments, the amount of soap is 8 to 20 weight %.

Surfactant refers to any anionic, nonionic, cationic, amphoteric, or zwitterionic surfactant. The total amount of surfactant can be any desired amount. In certain embodiments, the amount of surfactant in the soap bar is 5 to 25 weight %, 8 to 25 weight %, 10 to 25 weight %, 10 to 20 weight %, 5 to 15 weight %, or 10 to 15 weight %. Examples of anionic surfactant include, but are not limited to, alkyl ($C_6$-$C_{22}$) materials such as alkyl sulfates, alkyl sulfonates, alkyl benzene sulfonates, lauryl sulfates, lauryl ether sulfates, alkyl phosphates, alkyl ether sulfates, alkyl alpha olefin sulfonates, alkyl taurates, alkyl isethionates (SCI), alkyl glyceryl ether sulfonates (AGES), sulfosuccinates and the like. These anionic surfactants can be alkoxylated, for example, ethoxylated, although alkoxylation is not required. These surfactants are typically highly water soluble as their sodium, potassium, alkyl and ammonium or alkanol ammonium containing salt form and can provide high foaming cleansing power. In certain embodiments, examples of anionic surfactants include, but are not limited to, sodium lauryl ether (laureth) sulfate (average of 2 to 15 EO per mole, such as 2, 3, 4, or 5) sodium cocoyl isethionate, and sodium cocoyl methyl isethionate. For laundry, examples of anionic surfactants include, but are not limited to, alkyl sulfates, such as sodium lauryl sulfate, ammonium alkyl sulfate salts, alkyl ethoxylate sulfates, alkylbenzene sulfonates, such as dodecylbenzene sulfonate, nonionic surfactants, polyethoxylated alcohols, such as $C_{12}$-$C_{13}$ alcohol with an average of 6.5 ethoxyl units, polyhydroxy fatty acid amides, such as $C_{12}$-$C_{13}$ amide with N-linked methyl or N-linked reduced sugar. Anionic surfactants can be included in any desired amount. In one embodiment, anionic surfactants are present in the amounts given above for surfactants.

Examples of zwitterionic/amphoteric surfactants include, but are not limited to, derivatives of aliphatic secondary and tertiary amines in which the aliphatic radical can be straight chain or branched and wherein one of the aliphatic substituents contains about 8 to about 18 carbon atoms and one contains an anionic water solubilizing group, e.g., carboxy, sulfonate, sulfate, phosphate, or phosphonate. Examples of such compounds include sodium 3-dodecyaminopropionate, sodium 3-dodecylaminopropane sulfonate, N-alkyl taurines and N-higher alkyl aspartic acids. Other equivalent amphoteric surfactants may be used. Examples of amphoteric surfactants include, but are not limited to, a range of betaines including, for example, high alkyl betaines, such as coco dimethyl carboxymethyl betaine, lauryl dimethyl carboxymethyl betaine, lauryl dimethyl alpha-carboxyethyl betaine, cetyl dimethyl carboxymethyl betaine, lauryl bis-(2-hydroxyethyl)carboxy methyl betaine, stearyl bis-(2-hydroxypropyl)carboxymethyl betaine, oleyl dimethyl gamma-carboxypropyl betaine, and lauryl bis-(2-hydroxypropyl)alpha-carboxyethyl betaine, sulfobetaines such as coco dimethyl sulfopropyl betaine, stearyl dimethyl sulfopropyl betaine, amido betaines, amidosulfobetaines and the like. Betaines having a long chain alkyl group, particularly coco, may be particularly useful as are those that include an amido groups such as the cocamidopropyl and cocoamidoethyl betaines. In one embodiment, the zwitterionic surfactant comprises cocamidopropyl betaine. Zwitterionic/amphoteric surfactants can be included in any desired amount. In one embodiment, zwitterionic/amphoteric surfactants are present in the amounts given above for surfactants.

Examples of nonionic surfactants include, but are not limited to, ethoxylated fatty alcohols (such as the steareth-2 to steareth-100 series from Croda Chemicals, Inc. sold under the trademark Brij, such as steareth-2, steareth-4, steareth-10, steareth-20, or steareth-100), polysorbate 20, long chain alkyl glucosides having $C_8$-$C_{22}$ alkyl groups; coconut fatty acid monoethanolamides such as cocamide MEA; coconut fatty acid diethanolamides, fatty alcohol ethoxylates (alkylpolyethylene glycols); alkylphenol polyethylene glycols; alkyl mercaptan polyethylene glycols; fatty amine ethoxylates (alkylaminopolyethylene glycols); fatty acid ethoxylates (acylpolyethylene glycols); polypropylene glycol ethoxylates (for example the Pluronic™ block copolymers commercially available from BASF); fatty acid alkylolamides, (fatty acid amide polyethylene glycols); N-alkyl-, N-alkoxypolyhydroxy fatty acid amides; sucrose esters; sorbitol esters; polyglycol ethers; and combinations thereof. Nonionic surfactants can be included in any desired amount. In one embodiment, nonionic surfactants are present in the amounts given above for surfactants.

Optionally, the soap bar can contain foam boosters. Examples of foam boosters include, but are not limited to, certain amphoteric surfactants, cocomonoethanolamide (CMEA), cocoamidopropylamine oxide, cetyl dimethylamine chloride, decylamine oxide, lauryl/myristyl amidopropyl amine oxide, lauramine oxide, alkyldimethyl amine n-oxide, and myristamine oxide. in certain embodiments, the amount of foam booster is up to 10%, optionally 2 to 10 weight %.

Optionally, the soap bar can contain any additional materials that are added to personal cleansing or laundry bars. Examples include, but are not limited to, coloring agent, dye, pigment, fragrance, preservative, biocide, antibacterial agent, exfoliating/scrubbing particles, and filler.

The soap bar may optionally include a structurant. The primary structurant of the bar composition is a gellant selected from the group consisting of dibenzylidene sorbitol, dibenzylidene xylitol, dibenzylidene ribitol, and mixtures thereof. Particular amounts of such primary gellants include quantities of the gellant can include a minimum of at least 0.1 or 0.5 weight % and a maximum of 1 or 2 weight %, with particular ranges being 0.1-2 weight % and 0.5-2 weight %. A preferred range of the dibenzylidene sorbitol gellant is about 0.2% to about 1.0%.

A secondary structurant (a material that makes the bar harder) can also optionally be included in the composition. Exemplary of a structurant is alkali halides and alkali metal sulfates such as sodium chloride and sodium sulfate. Particular levels of such a secondary structurant are a minimum of about 0.1 or 0.2 weight % and a maximum of 1, 2, 3 or 4 weight %. Examples of particular ranges include 0.1-4 weight %, 0.1-2 weight %, and 0.2-4 weight %. It is preferable that the secondary structurant be at least about 1% and be selected to be sodium chloride.

The soap bar may optionally include a humectant. A humectant is a polyhydric alcohol organic material which assists in solubilizing soap. Examples of such materials include propylene glycol, dipropylene glycol, glycerin, sorbitol, mannitol, xylitol, hexylene glycol, and the like. More particular values for humectants include a minimum of about 8, 10, 15 or 20 weight %, and a maximum off about 50, 40, or 30 wt. % of the composition. A particular feature of this humectants ingredient is the requirement that the humectant must include glycerin in an amount of at least about 2 weight % of the bar and a maximum of about 10 weight %. Thus, particular ranges for humectants include 8-50 weight %, 10-50 weight %, 15-50 weight %, 10-40 weight %, 15-50 weight %, and 20-50 weight %. In one embodiment, the amount of glycerin in the bar product is from about 2 to about 6 weight %.

Lower monohydric alkanols may also be present in the composition. Examples of suitable lower monohydric alkanols are methanol, ethanol, propanol, isopropanol, and the like. More particular values for the quantity of lower monohydric alkanol present in the composition are a minimum of 0.1 or 0.2 weight % and a maximum quantity is about 1 or 2 weight %. Thus, particular ranges include 0.1-2 weight % and 0.2-2 weight %.

Skin conditioning ingredients (including emollients) may also be included in the compositions of the invention. Such ingredients include:

(a) various fats and oils (examples include soybean oil, sunflower oil, canola oil, various unsaturated long chain oils and fats in general, shea butter and the like. Quantities of these fats and oils can be a minimum that provides a skin feel up to a maximum that provides skin feel while still achieving translucency and wear rate of the composition. Generally, this is about 0.5 to about 4 weight % of the composition preferably about 1.0 to about 3.0 weight %;

(b) glyceryl esters comprising a subgroup of esters which are primarily fatty acid monoglycerides, diglycerides or triglycerides modified by reaction with other alcohols and the like; particularly fatty acids having a carbon chain of 12 to 18 carbons (for example, PEG 6 caprylic/capric triglycerides, PEG 80 glyceryl cocoate, PEG 40 glyceryl cocoate, PEG 35 soy glyceride);

(c) alkyloxylated derivatives of dimethicone (for example, such as PEG/PPG-22/24 Dimethicone and PEG-8 Dimethicone);

(d) silicone esters such as those selected from the group consisting of silicon phosphate esters, materials prepared by the esterification reaction of a dimethiconol and a fatty acid (for example, C12-18 fatty acid), and materials prepared by the reaction of a dimethicone copolyol with a fatty acid (for example, Dimethicone PEG-7 isostearate, the partial ester of PEG-7 dimethicone and isostearic acid) (see also: Conditioning Agents for Hair and Skin. Edited by R. Schueller and P. Romanowsi, pages 201-221.);

(e) silicone quaternium compounds (such as Silicone Quaternium-8);

(f) lanolin quaternium compounds;

(g) cationic polymers (such as Polyquatemium-6 and Polyquaternium-7); and (h) silicone polymers of the following classes: dimethiconol, dimethicone copolyol, alkyl dimethicone copolyol, dimethicone copolyol amine (see also Conditioning Agents for Hair and Skin. Edited by R. Schueller and P. Romanowsi. Pages 201-221).

These skin feel materials can be used in relatively minor quantities that are from about 0.05 to about 3 to 4 weight % of each of these as long as skin feel, wear rate, and translucency are maintained. Mixtures of conditioning agents can also be used.

More particular examples of skin feel conditioning agents that maintain translucency and provide a nice skin feel when added to a translucent composition of the invention at a level of 2 weight % are those selected from the group consisting of: soybean oil, PEG 6 caprylic/capric triglycerides, PEG 80 glyceryl cocoate, PEG 40 glyceryl cocoate, PEG 35 soy glycerides, caprylic/capric triglycerides, PEG 8, dimethicone, PEG/PPG-22/24 dimethicone, silicone quatemium-8, dimethicone PEG-7 isostearate, petrolatum, lanolin quat (quaternium-33), capric/caprylic triglycerides, PEG-7 glyceryl cocoate, and mixtures of the foregoing.

For a pearlescent soap bar, compositions of this invention may comprise mica at about 0.1 to 1 weight %.

For an opaque soap bar, compositions of this invention may comprise an opacifying agent, such as titanium dioxide, at about 0.1 to 1 wt %.

SPECIFIC EMBODIMENTS OF THE INVENTION

The invention is further described in the following Examples. The Examples are merely illustrative and do not in any way limit the scope of the invention as described and claimed. This invention can be further illustrated by the following Examples of preferred embodiments thereof, although it will be understood that these Examples are included merely for purposes of illustration and are not intended to limit the scope of the invention unless otherwise specifically indicated.

Example 1: Synthesis of Oil-in-Water Emulsion

An oil-in-water emulsion was prepared and investigated by light microscopy.

Materials and Methods

Deionised water (949.4 g) was heated to 70° C. Steareth 20 (12 g) was then added with stirring while maintaining the temperature of the solution at 70° C., to produce an aqueous phase. In a separate vessel, polypropylene glycol-15 stearyl ether (15.6 g) was added to steareth-2 (23 g) and heated to 62° C. to form an oil phase.

The aqueous phase was placed in a homogeniser. The oil phase was slowly added. The resulting mixture was homogenised for 3 minutes at 55 rpm and a temperature of approximately 70° C. The homogenised mixture was then allowed to cool to room temperature and investigated by light microscopy. Discrete oil droplets were visible, indicating that an emulsion was formed.

Example 2: Incorporation of an Oil-in-Water Emulsion into Soap Bars

Soap bars comprising the oil-in-water emulsion of Example 1 were prepared. Control bars, consisting essentially of soap, and comparative bars containing approximately 10% water were also produced. The soap compositions of the present invention were found to have comparable process parameters to the control.

Materials and Methods

Soap chips (900 g) were gently mixed with the oil-in-water emulsion of Example 1 (100 g). The resulting mixture was transferred to the hopper of an extruder. The temperature of the barrel of the extruder was adjusted to about 38° C. (100° F.). The soap mixture was then refined three times using a 1 mm perforated plate. A heated billet cone was attached to the plodder and soap billets were produced. The soap billets were then cut into sections and pressed into bars.

A comparative soap bar comprising 10% water by weight was prepared according to the method set out above, by substituting the oil-in-water emulsion with deionised water. A control bar consisting of soap was also prepared by omitting the oil-in-water emulsion from the composition.

Example 3: Cracking Test

If different regions of a soap bar have different solubilities in water, particularly cold water, then crevices will form as the more soluble regions dissolve more quickly than the less soluble regions. This effect is referred to as wet cracking. A cracking test was performed to illustrate that the soap bars of the present invention show comparable wet crack performance to a control and to a soap bar comprising 10% water.

Materials and Methods

Small (0.6 cm) holes were drilled from the front face to the back face of the bars of Example 2 at about 1.5 cm from the end of each bar. A metal rod was inserted through the bars. The bars were spaced such that they were not in contact with one another. The bars were then suspended in a container of water at room temperature for a period of four hours. The bars were then removed from the water and allowed to dry on the rod for 24 hours. Following the drying period, the extent of cracking was visually evaluated. The cracking results were rated from no cracking, low cracking, moderate cracking and high cracking.

Results and Discussion

The soap bars of the present invention displayed only a minimal amount of cracking Similar results were observed for both the control bar and the 10% water bar. The inclusion of the emulsion does not therefore adversely affect bar cracking.

Example 4: Slough Testing

Slough testing assesses the amount of material lost from a soap bar following prolonged exposure to moisture. The soap bars of the present invention were found to have improved performance compared to a control.

Materials and Methods

Each of the bars of Example 2 was pre-washed by rotating the bar for 30 seconds under a gentle stream of 38° C. (100° F.) tap water. Each bar was then placed in a dish containing approximately 35 ml of tap water. The bars were then allowed to stand for 17½ hours. The slough was immediately removed and the bars placed into dry soap dishes and allowed to dry for 24 hours at room temperature. The reduction in the mass of the bars was then recorded.

Results and Discussion

The results of the slough testing are set out in Table 1, below.

TABLE 1 slough testing results

| Soap bar | Initial weight/g | Final weight/g | Weight loss (slough)/% | Mean weight loss/% |
|---|---|---|---|---|
| Control | 100.9 | 83.8 | 16.9 | 17.4 |
| Control | 100.9 | 82.9 | 17.8 | |
| 10% Emulsion | 100.1 | 84.1 | 15.9 | 16.3 |
| 10% Emulsion | 99.8 | 83.1 | 16.7 | |
| 10% Water | 99.6 | 83.1 | 16.5 | 16.7 |
| 10% Water | 99.4 | 82.6 | 16.9 | |

The data show that the emulsion bars of the present invention lost less weight in a similar amount to the control.

Example 5: Wear Rate

The soap bars of the present invention were found to display similar wear rates to a control.

Materials and Methods

The soap bars of Example 2 were weighed. Each bar was washed for 10 seconds in warm (35° C. to 38° C. (95° F. to 100° F.)) tap water. The washes were repeated at 30 minute intervals over a period of 6 hours. The bars were then allowed to dry for 24 hours at room temperature in dry soap dishes. The final weights of the bars were then recorded.

The results of the wear rate test are presented in Table 2 below. The use up rate was calculated according to Formula 1:

$$\text{Use-up rate}=((\text{initial weight}-\text{final weight})/\text{initial weight})\times 100$$

TABLE 2 wear rate test results

| Soap bar | Initial weight/g | Final weight/g | Weight loss/g | Use-up rate/% | Mean use-up rate/% |
|---|---|---|---|---|---|
| Control | 101.0 | 82.3 | 18.6 | 18.5 | 17.3 |
| Control | 101.2 | 84.8 | 16.4 | 16.2 | |
| 10% Emulsion | 99.7 | 82.9 | 16.7 | 16.8 | 17.2 |
| 10% Emulsion | 100.3 | 82.6 | 17.7 | 17.7 | |
| 10% Water | 99.3 | 83.7 | 15.6 | 15.7 | 16.7 |
| 10% Water | 99.6 | 81.9 | 17.6 | 17.7 | |

The data above show that the wear rate of the bars of the present invention is equal to the wear rate of the control bar to within experimental error.

Example 6: Moisture Lost During Processing

The processing of a soap composition can result in the loss of moisture. It was found that the soap bars of the present invention retain a larger amount of moisture than the control and comparative (10% water) bars.

Materials and Methods

Theoretical moisture levels for the soap bar compositions of Example 3 were calculated according to standard methods. The moisture content of the bars produced using the method according to Example 3 were recorded.

Results and Discussion

The theoretical moisture levels and measured moisture levels for the three soap bar compositions are set out in Table 3 below.

TABLE 3 measured and calculated moisture levels

| Soap bar | Moisture before process/% | Theoretical moisture level/% | Moisture after process % | Difference/% | Moisture loss/% |
|---|---|---|---|---|---|
| Control | 13.2 | 13.2 | 13.6 | −0.4 | −3.0 |
| 10% Emulsion | 14.2 | 24.2 | 21.4 | 2.8 | 11.6 |
| 10% Water | 14.2 | 24.2 | 17.8 | 6.4 | 26.4 |

The soap bars of the present invention were found to contain approximately 21.4% moisture. This is significantly more than the control and comparative compositions. The inclusion of an oil-in-water emulsion in a soap bar composition therefore allows a higher proportion of moisture to be incorporated into the bars. The result shows that the 10% water bar loses more than double water comparable to 10% emulsion bar during process. The result indicates that 10% emulsion bar could hold more water during process than 10% water bar.

Example 7: Skin Feel and Lather Evaluation Panel Study

In a skin feel and lather evaluation study, the bars of the present invention were rated higher than the control for "feels soft" and lower than the control for "feels dry". The bars of the present invention produced comparable lather to the control.

Materials and Methods

Panelists washed each arm with either a soap bar of the present invention or a control based on a randomized schedule. They rubbed the bar on their forearm for 10 seconds, lathered for 30 seconds and rinsed as normal. The arms were patted dry with paper towels. 10 minutes after drying, each arm was evaluated for: "feels clean", "feels moisturised", "feels soft", "feels smooth", "feels dry", "looks dry" and "feels draggy". Panelists were then asked to select the arm that they preferred for skin feel. Evaluations are conducted immediately and at 10 minutes.

Panelists evaluated the lather of each bar by rolling the bar 10 times under running tap water and washing their hands for 20 seconds. They were asked to select which bar generated the lather they preferred.

Results and Discussion

The results of the skin feel evaluation are set out in Table 4.

TABLE 4 skin feel evaluation data

| Treatment | Evaluation | Feels clean | Feels moisturized | Feels soft | Feels smooth | Feels dry | Looks dry | Feels draggy | Prefer |
|---|---|---|---|---|---|---|---|---|---|
| Control | Immediate | 8.3 | 5.8 | 6.4 | 6.1 | 4.2 | 3.4 | 3.0 | 9 |
| 10% Emulsion | Immediate | 8.1 | 6.7 | 6.9 | 6.5 | 3.6 | 2.8 | 3.0 | 6 |
| Control | 10 min | 8.2 | 5.3 | 6.0 | 6.2 | 4.7 | 3.1 | 3.4 | 8 |
| 10% Emulsion | 10 min | 8.1 | 6.4 | 6.8 | 6.8 | 3.5 | 3.3 | 3.2 | 7 |

The bars of the present invention were rated higher than the control for "feels soft" and lower for "feels dry".

No significant differences in lathering were observed by which bar was preferred.

Example 8: Skin Feel and Lather Evaluation Panel Study

The soap bars of the present invention were found to produce comparable skin feel to bars containing 10% water. The bars of the present invention however provided improved lathering.

Materials and Methods

The experiments described in Example 7 above were repeated, substituting the comparative (10% water) bar for the control. Panellists carried out an evaluation immediately after drying.

Results and Discussion

The results of the skin feel evaluation are set out in Table 5.

TABLE 5 skin feel evaluation data

| Treatment | Evaluation | Feels clean | Feels moisturized | Feels soft | Feels smooth | Feels dry | Looks dry | Feels draggy | Prefer |
|---|---|---|---|---|---|---|---|---|---|
| 10% Emulsion | Immediate | 8.1 | 6.6 | 6.4 | 6.6 | 3.2 | 2.2 | 2.6 | 7 |
| 10% Water | Immediate | 8.4 | 6.8 | 6.3 | 6.1 | 3.5 | 2 | 2 | 8 |
| 10% Emulsion | 10 min | 8 | 6.5 | 6.5 | 6.7 | 4.5 | 3.7 | 2.3 | 10 |
| 10% Water | 10 min | 8.1 | 5.9 | 5.9 | 6.5 | 4.8 | 4.5 | 2.9 | 5 |

Four fifths of the panelists preferred the lather of the emulsion bar to that of the 10% water bar.

The soap bars of the present invention provide increased perception of skin moisturization and reduced perception of skin dryness 10 minutes after washing in comparison to a standard control soap. The emulsion bar of the present invention was found to be strongly preferred over the bar containing 10% water.

Example 9: Deposition of TCC from the Emulsion

The oil in water emulsion can increase deposition of hydrophobic ingredients. Triclocarban (TCC) in an oil in water emulsion is compared to a control bar with TCC added directly and with TCC in a surfactant. The surfactant is laureth-7.

953 g of laureth-7 is heated in a beaker to 70° C., and 47 g of TCC is added while mixing until composition is clear.

An emulsion is prepared by preparing an aqueous phase with 545 g of water, which is heated to 70° C., and 12 g of steareth-20 is added and mixed. The temperature is maintained at 70° C. The aqueous phase is placed under a homogenizer and mixing is started. 420 g of the laureth-7/TCC mixture (400 g laureth-7 and 20 g TCC) is heated to 62° C., mixed with 23 g of steareth-2, and added to the aqueous phase. The mixture is homogenized for 3 min at 55 rpm at a temperature of 70° C. After mixing, the mixture is cooled to room temperature.

A control soap bar is prepared by mixing 1 g TCC with 999 g of soap chips and forming a soap bar. A second control bar is prepared, by mixing 979 g of soap chips with 21 g of the laureth-7/TCC mixture (20 g laureth-7 and 1 g TCC) and forming a soap bar. An oil in water emulsion bar is prepared by mixing 950 g of soap chips with 50 g of the emulsion (contains 1 g of TCC in this bar) and forming a soap bar.

Deposition of TCC from the soap bars is conducted as follows. 0.5 wt. % of soap solutions containing TCC are prepared in deionized water. 20 ml samples of soap solutions are placed in 240 ml (8 oz jars) to which Vitro Skin (IMS Inc, Portland, Me.), cut into 5.1 cm×5.1 cm (2"×2") squares, are placed. This was done in triplicate. The samples are equilibrated at 40° C. for 5 minutes with shaking using an orbital shaker (VWR Model 1570) set at 100 rpm. Vitro skin samples are removed, rinsed in deionized water and air-dried for 6 h. The skin samples are cut into 1 cm×1 cm squares and placed into scintillation vials to which 5 ml of ethanol is added. The skin/ethanol samples are equilibrated for 48 h with intermittent vortexing and the ethanol is removed using Pasteur pipets and placed into 7 ml test tubes. The extracted ethanol is concentrated to complete dryness using a vacuum concentrator (Genevac Evaporator EZ-2 Vacuum Concentrator, Genevac Corp, NY) and 0.3 ml of ethanol are added to each tube. The samples were vortexed again and transferred to HPLC vials for analysis of TCC. Table 6 below shows the amount of TCC deposited by area in both mass and moles.

TABLE 6

| Sample # | TCC Area | ppm(E) | gm/ sq. cm skin | p moles/ sq cm | Average p moles/ sq cm |
|---|---|---|---|---|---|
| Control with 0.1% TCC | 667 | 10.33 | 6.01E−08 | 190.35 | 187 |
| | 621 | 9.62 | 5.59E−08 | 177.22 | |
| | 681 | 10.55 | 6.13E−08 | 194.35 | |

TABLE 6-continued

| Sample # | TCC Area | ppm(E) | gm/ sq. cm skin | p moles/ sq cm | Average p moles/ sq cm |
|---|---|---|---|---|---|
| Control with 0.1% | 2.27E+02 | 3.52 | 2.04E−08 | 64.78 | 90 |
| TCC and Laureth-7 | 2.40E+02 | 3.72 | 2.16E−08 | 68.49 | |
| | 4.78E+02 | 7.40 | 4.30E−08 | 136.41 | |
| Emulsion bar with | 9.70E+02 | 15.03 | 8.73E−08 | 276.82 | 281 |
| 0.1% TCC | 1.06E+03 | 16.43 | 9.55E−08 | 302.79 | |
| | 9.22E+02 | 14.28 | 8.30E−08 | 263.13 | |

As can be seen in the table above, the oil in water emulsion increases the deposition of the hydrophobic material (TCC) onto vitro skin. This also shows that the structure of the composition is different from adding materials individually to a bar. The emulsion structure in the bar allows for increased deposition of a hydrophobic ingredient.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A soap bar composition comprising solid soap and an oil-in-water emulsion, wherein the emulsion comprises oil, one or more surfactants, and emulsion water, wherein a ratio of the oil to the one or more surfactants is from 0.33:1 to 0.67:1, wherein the emulsion water is present in the emulsion in an amount of at least 95% by weight of the emulsion, wherein the emulsion is dispersed within the solid soap, and wherein the emulsion before incorporation into the soap bar comprises 9.4 to 15% of the emulsion water by weight of the soap bar composition.

2. The composition of claim 1 wherein total water in the soap bar composition is 20 to 35% by weight of the soap bar composition.

3. The composition of claim 1, wherein the emulsion is present in the composition in an amount of at least 5% by weight of the composition.

4. The composition of claim 1, wherein the emulsion water is present in the emulsion in an amount of from 95% to 98% by weight of the emulsion.

5. The composition of claim 4, wherein the oil is present in the emulsion in an amount of from 1% to 3% by weight of the emulsion.

6. The composition of claim 1, wherein the one or more surfactants has an HLB of less than 13.

7. The composition of claim 1, wherein the one or more surfactants are present in a total amount in the range of 1% to 6% by weight of the emulsion.

8. The composition of claim 1, wherein the oil is PPG-15 stearyl ether.

9. The composition of claim 1, wherein the one or more surfactants is selected from the group consisting of: steareth-2, steareth-20, and mixtures thereof.

10. The composition of claim 1, wherein the solid soap comprises a salt of lauric acid, a salt of coconut oil, palm kernel oil, palm stearin fatty acid, and/or a salt of tallow.

11. The composition of claim 10, wherein the salt of lauric acid is present in an amount of about 5% and the salt of tallow is present in an amount of 95% by weight of the soap.

12. The composition of claim 1, wherein the emulsion consists of the oil, the one or more surfactants, the emulsion water, and an antimicrobial agent.

13. The composition of claim 1, wherein the emulsion consists of the oil, the one or more surfactants, the emulsion water, and a fragrance.

14. The composition of claim 1, wherein the emulsion consists of the oil, the one or more surfactants, the emulsion water, an antimicrobial agent, and a fragrance.

15. The composition of claim 1, wherein the emulsion consists essentially of the oil, the one or more surfactants, the emulsion water, and a functional ingredient, wherein the functional ingredient is an antimicrobial agent or a fragrance.

16. The composition of claim 1, wherein the ratio of the oil to the one or more surfactants is from 0.4:1 to 0.67:1.

17. The composition of claim 1, wherein the ratio of the oil to the one or more surfactants is from 0.5:1 to 0.67:1.

18. The composition of claim 1, wherein the ratio of the oil to the one or more surfactants is about 0.43:1.

* * * * *